US006099942A

United States Patent [19]

Yakushinji

[11] Patent Number: 6,099,942

[45] Date of Patent: Aug. 8, 2000

[54] WEED CONTROL BLOCK AND WEED CONTROL STRUCTURE FOR BLOCK

[76] Inventor: Kuniaki Yakushinji, 59-2 Matsugaoka, Ooita-shi, Ooita 870-1168, Japan

[21] Appl. No.: 09/088,705

[22] Filed: Jun. 2, 1998

[30] Foreign Application Priority Data

Jun. 23, 1997 [JP] Japan ..... 9-183060

[51] Int. Cl.[7] ..... B32B 23/02

[52] U.S. Cl. ..... 428/192; 428/156; 52/102; 52/173.3; 52/610

[58] Field of Search ..... 428/15, 12, 13, 428/17, 192, 156; 47/61, 1.01; 172/776; 52/102, 173.3, 610

[56] References Cited

U.S. PATENT DOCUMENTS

| | | | |
|---|---|---|---|
| 2,604,023 | 7/1952 | Messiah | 94/33 |
| 5,395,179 | 3/1995 | Kotani | 404/71 |
| 5,591,465 | 1/1997 | Shields | 219/213 |

FOREIGN PATENT DOCUMENTS

| | | |
|---|---|---|
| 0 558 845 A1 | 9/1983 | European Pat. Off. . |
| 61-40405 | 3/1986 | Japan . |
| 1-124806 | 8/1989 | Japan . |
| 8-113906 | 5/1996 | Japan . |

*Primary Examiner*—Deborah Jones
*Assistant Examiner*—Abraham Bahta
*Attorney, Agent, or Firm*—Armstrong, Westerman, Hattori, McLeland & Naughton

[57] ABSTRACT

A weed control apron block (10) laid on the boundary of a sidewalk. A step portion (113) is provided on the sidewalk-side upper end edge (111) of the weed control apron block (10). A member having a high thermal conductivity, e.g. an iron plate (20), is installed in the step portion (113). The iron plate (20) is a flat plate member extending over the entire longitudinal length of the step portion (113). A heating wire may be installed in the step portion (113).

18 Claims, 7 Drawing Sheets

WEED CONTROL BLOCK AND WEED CONTROL STRUCTURE FOR BLOCK

BACKGROUND OF THE INVENTION

The present invention relates to weed control blocks laid on the boundary of a sidewalk to prevent the propagation of weeds. The present invention also relates to a weed control structure suitable for blocks laid on the boundary of a sidewalk.

As shown for example in FIG. 6, a conventional concrete apron block 60 is installed on a boundary dividing a roadway 70 and a sidewalk 75. The apron block 60 has an approximately L-shaped cross-section. In the roadway 70, gravel 71 and asphalt 73 are laid; in the sidewalk 75, gravel 77 and asphalt 79 are laid.

Incidentally, the thicknesses of the gravel 77 and asphalt 79 in the sidewalk 75 are smaller than those of the gravel 71 and asphalt 73 in the roadway 70.

Therefore, the conventional apron block 60 suffers from some problems. If seeds of weeds 80 germinate in a gap a produced in the boundary between the apron block 60 and the asphalt 79, the roots 81 of the weeds 80 readily reach the soil 83 through short distances. As the years pass, the weeds 80 spread deep root and become eyesores. The weeds 80 narrow the effective width of the sidewalk 75 and cause the mowing cost to increase. The weeds 80 also cause the asphalt 79 to be cracked and make the surface of the asphalt 79 unfavorably raised.

One approach to solve the above-described problems is as follows. As shown in FIG. 7, an apron block 60-2 is provided with a notch-shaped step portion 65 longitudinally extending along an upper end edge of the apron block 60-2 which is closer to the sidewalk 75. Asphalt 79 is placed so as to cover the step portion 65, thereby increasing the distance H traveled by the roots 81 of the weeds 80 entering through the gap a to reach the soil 83, and thus making it difficult for the weeds 80 to spread.

However, some of the fertile weeds 80 still take root through the gap a. Therefore, there has been a demand for appearance of a block capable of preventing the propagation of weeds even more effectively.

SUMMARY OF THE INVENTION

Accordingly, an object of the present invention is to provide a weed control block capable of effectively preventing the propagation of weeds and also provide a weed control structure for blocks laid on the boundary of a sidewalk.

The present invention provides a weed control block laid on the boundary of a sidewalk, wherein a portion of the block which is closer to the sidewalk is provided with a step portion extending longitudinally of the block, and a member having a high thermal conductivity or a heating wire is installed in the step portion.

According to the weed control block arranged as stated above, the step portion lengthens the distance traveled by the root of a weed to reach the soil and makes it difficult for the root to reach the soil. At the same time, the root of the weed is passed between asphalt heated to a high temperature by solar heat and the member having a high thermal conductivity, or the root is heated by the heating wire. By the synergistic effect thus obtained, the growth of the root of the weed germinating in a gap produced in the boundary between the block and the sidewalk-side asphalt is inhibited considerably, and thus the propagation of weeds can be effectively prevented.

In addition, the present invention provides a weed control structure for a block laid on the boundary of a sidewalk, wherein a heating wire is buried in the boundary between the block and the paved surface of the sidewalk to burn the root of a weed.

According to the weed control structure arranged as stated above, the root of the weed is heated by the heating wire, thereby considerably inhibiting the growth of the root of the weed germinating in a gap produced in the boundary between the block and the sidewalk-side asphalt. Thus, the propagation of weeds can be effectively prevented.

DESCRIPTION OF THE PREFERRED EMBODIMENTS

Embodiments of the present invention will be described below in detail with reference to the accompanying drawings.

[First Embodiment]

Figure 1:
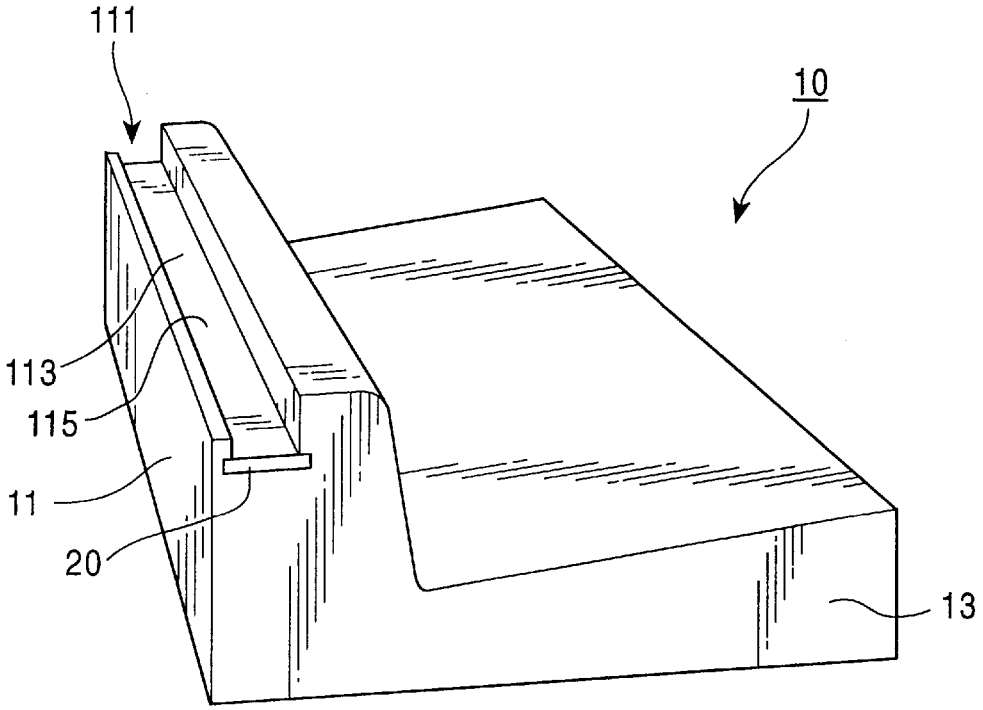
FIG. 1 is a perspective view of a weed control apron block according to a first embodiment of the present invention.
Figure 2:
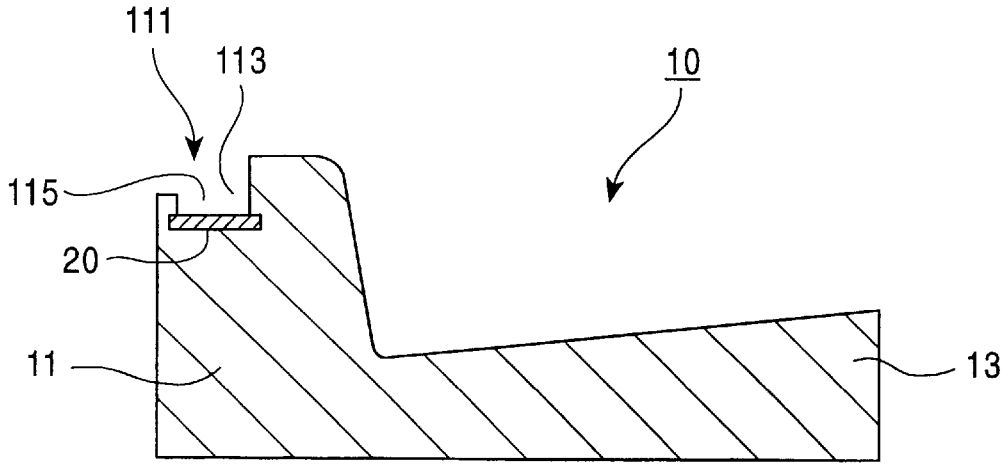
FIG. 2 is a sectional view of the weed control apron block.

FIG. 1 is a perspective view of a weed control apron block 10 according to a first embodiment of the present invention, and FIG. 2 is a sectional view of the weed control apron block 10. As shown in the figures, the weed control apron block 10 is an integrally-formed concrete block having an approximately L-shaped cross-section. A curb portion 11 of the weed control apron block 10 is provided with a notch-shaped step portion 113 longitudinally extending along an upper end edge 111 of the curb portion 11 which is closer to a sidewalk.

Further, a recess 115 is provided in the step portion 113. A flat iron plate (a member having a high thermal conductivity) 20 is installed on the bottom of the recess 115.

The iron plate 20 extends over the entire longitudinal length of the step portion 113. The surface of the iron plate 20 is exposed in the recess 115.

It should be noted that the weed control apron block 10 is usually produced in a factory.

Figure 3:
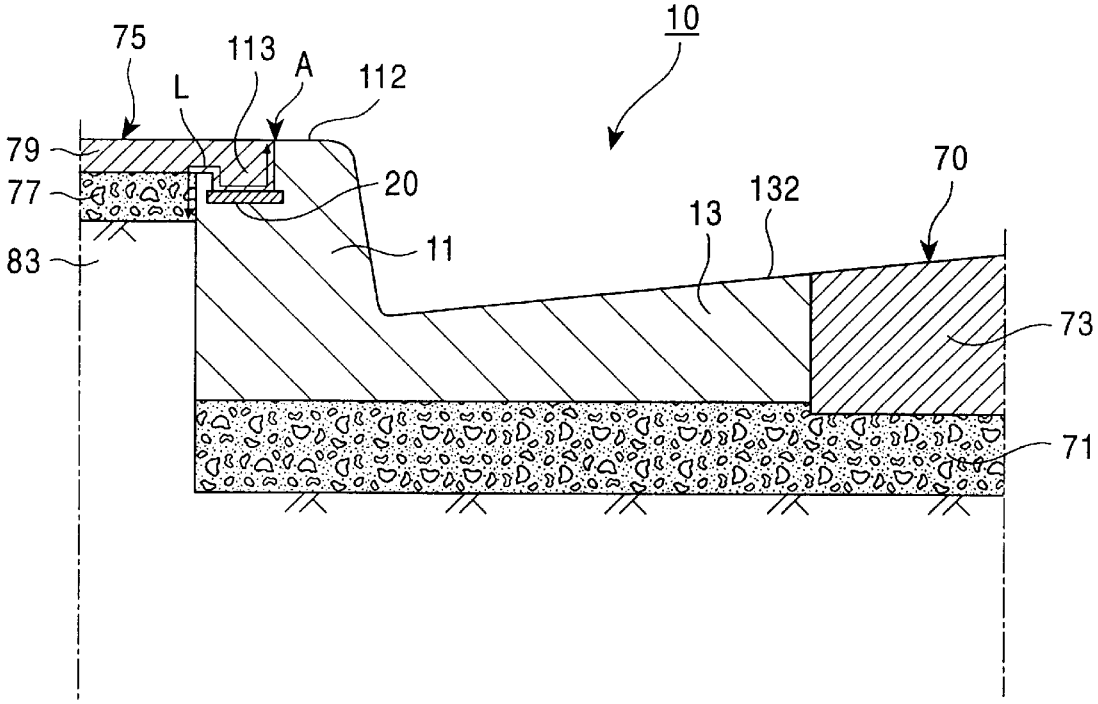
FIG. 3 is a sectional view showing an example of use of the weed control apron block.

FIG. 3 is a sectional view showing an example of use of the weed control apron block 10. Referring to the figure, the weed control apron block 10 is installed on a boundary dividing a roadway 70 and a sidewalk 75. In the roadway 70, gravel 71 and asphalt 73 are laid; in the sidewalk 75, gravel 77 and asphalt 79 are laid.

The asphalt 73 in the roadway 70 is laid to the level of the surface 132 of an apron portion 13 of the weed control apron block 10. The asphalt 79 in the sidewalk 75 is laid to the level of the surface 112 of the curb portion 11 of the weed control apron block 10. Accordingly, the whole step portion 113 is covered with the asphalt 79.

If a seed of a weed germinates in a gap A produced in the boundary between the weed control apron block 10 and the asphalt 79, the root of the weed tries to reach the soil 83 along a join line L between the step portion 113 and the asphalt 79. However, because the join line L is fairly long and meanders, it is not easy for the root of the weed to reach the soil 83. Accordingly, the growth of the root is inhibited considerably.

Moreover in the present invention, the iron plate 20 of high thermal conductivity is installed in the course of the join line L. Therefore, the growth of the root can also be inhibited markedly by solar heat. The reason for this will be explained below in detail.

Because of its constituent material, the asphalt 79 in the sidewalk 75 is heated up to a considerably high temperature when sunbeams are directly applied thereto in the daytime. At this time, the iron plate 20, which is in contact with the heated asphalt 79, absorbs heat therefrom at a higher rate than other surrounding members because the iron plate 20 has a high thermal conductivity. Accordingly, the iron plate 20 is heated up to a fairly high temperature as in the case of the asphalt 79.

Therefore, the root of the weed entering the gap between the heated asphalt 79 and iron plate 20 is heated at a high temperature from above and below it. Consequently, the growth of the root is inhibited considerably. In particular, the iron plate 20 has a high thermal conductivity and hence effectively transfers heat to the root of the weed. Accordingly, the iron plate 20 is suitable for heating the root to a high temperature. In addition, the area of the join line L can be favorably dried by the heat from the asphalt 79 and the iron plate 20.

In other words, a synergistic effect obtained by the use of solar heat and the long join line L stops the root of the weed germinating in the gap A from growing as far as the soil 83. Consequently, the weed becomes underdeveloped.

Incidentally, in a case where a part of the weed control apron block 10 is in the shadow of an obstacle such as a utility-line pole, the asphalt 79 in the shadowed part gets cold. In this embodiment, however, the iron plate 20 of high thermal conductivity is installed over the entire length of the weed control apron block 10; therefore, heat of the iron plate 20 heated in an unshadowed part of the weed conrtol apron block 10 spreads uniformly over the whole iron plate 20. Accordingly, the iron plate 20 can maintain a high-temperature state even in the shadowed part of the weed control apron block 10. Thus, the growth of the root of the weed can be inhibited evenly over the entire length of the weed conrtol apron block 10.

[Second Embodiment]

Figure 4:
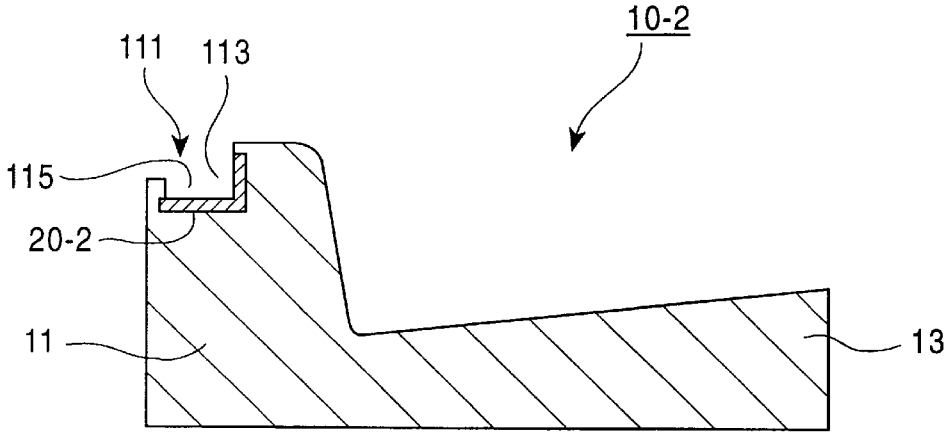
FIG. 4 is a sectional view of a weed control apron block according to a second embodiment of the present invention.

FIG. 4 is a sectional view of a second embodiment of the weed control apron block 10-2 according to the present invention. It should be noted that the same elements or portions as those in the first embodiment are denoted by the same reference numerals, and a detailed description thereof is omitted.

This embodiment differs from the first embodiment only in the shape of the iron plate 20-2. That is, the iron plate 20-2 in this embodiment is formed to have an L-shaped cross-sectional configuration, thereby increasing the area of the exposed surface of the iron plate 20-2 in the recess 115.

By virtue of this arrangement, the weed root growth inhibiting action by solar heat is enhanced.

[Third Embodiment]

Figure 9:
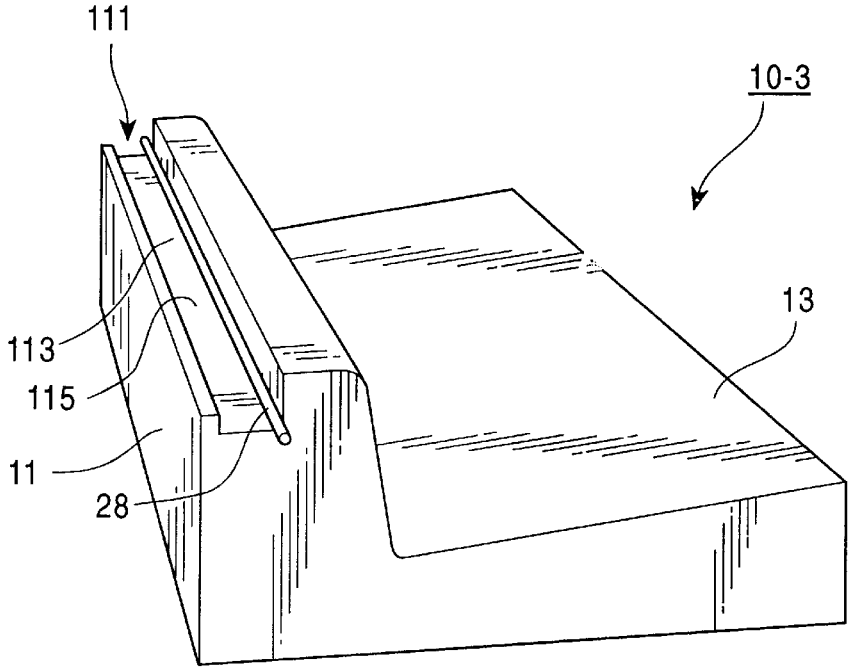
FIG. 9 is a perspective view showing a third embodiment of the present invention.

FIG. 9 is a perspective view of a third embodiment of the weed control apron block 10-3 according to the present invention. It should be noted that the same elements or portions as those in the first embodiment are denoted by the same reference numerals and a detailed description thereof is omitted.

This embodiment differs from the first embodiment in that a heating wire 28 adapted to generate heat by passing an electric current therethrough, for example, is installed in the recess 115 in place of the iron plate 20.

The heating wire 28 is installed as a single wire in the recesses 115 of a multiplicity of weed control apron blocks 10-3 laid linearly in a side-by-side relation to each other. The step portion 113, including the recess 115, is covered with the sidewalk-side asphalt as in the case of the first embodiment.

A voltage is periodically applied across the heating wire 28 to heat it. Consequently, the root of a weed entering a gap between the step portion 113 of the weed control apron block 10-3 and the asphalt covering the step portion 113 is surely burnt off. That is, in this embodiment, the growth of the roots of weeds is inhibited by utilizing electricity in place of solar heat.

It should be noted that the heating wire 28 may be installed in the recess 115 where the iron plate 20 is installed as shown in FIG. 1. In this case, the growth of the roots of weeds can be inhibited by using both solar heat and electricity.

[Fourth Embodiment]

Figure 10:
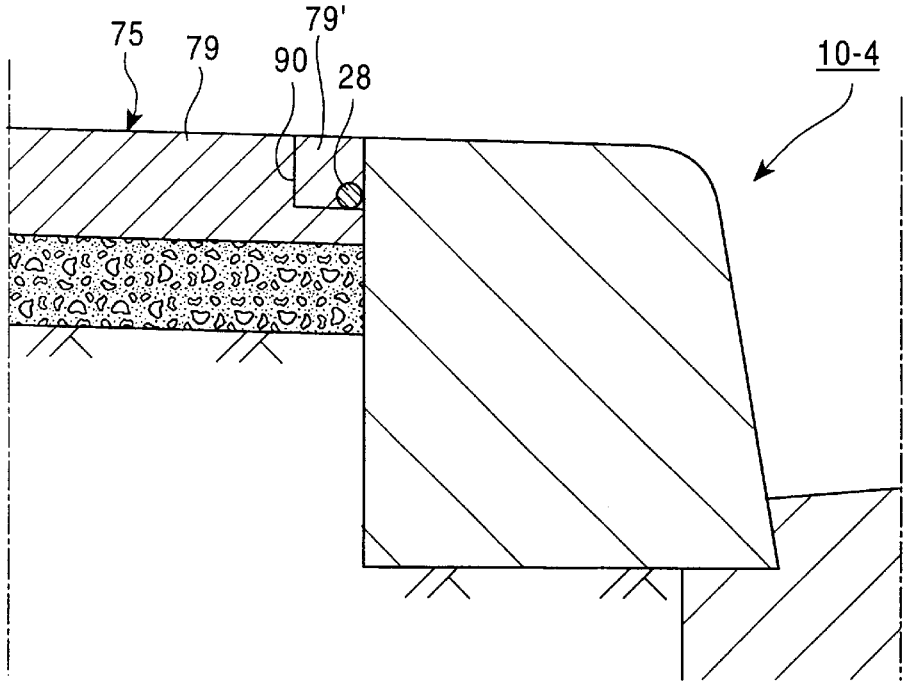
FIG. 10 is a sectional view showing a fourth embodiment of the present invention.

FIG. 10 is a sectional side view schematically showing an embodiment of the weed control structure for a block according to the present invention. In the present invention, a part of the road surface paved with asphalt 79 on the sidewalk (75) side of a block 10-4 already laid (or to be laid) is cut to form a recess 90, and a heating wire 28 is placed in the recess 90. Finally, the recess 90 is filled with asphalt 79'.

A voltage is periodically applied across the heating wire 28 as in the case of the third embodiment. Consequently, it is possible to surely burn off the root of a weed germinating in a gap between the asphalt 79 and the block 10-4.

Although the embodiments of the present invention have been described above in detail, the present invention is not necessarily limited to these embodiments but can be modified in a variety of ways, for example, as stated below.

Figure 5:
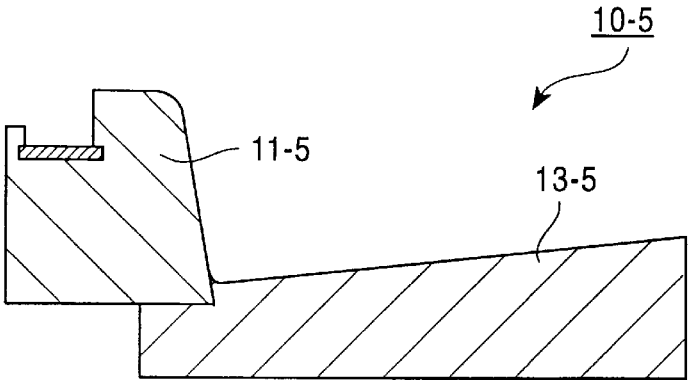
FIG. 5 is a sectional view of another weed control apron block according to the present invention.
Figure 6:
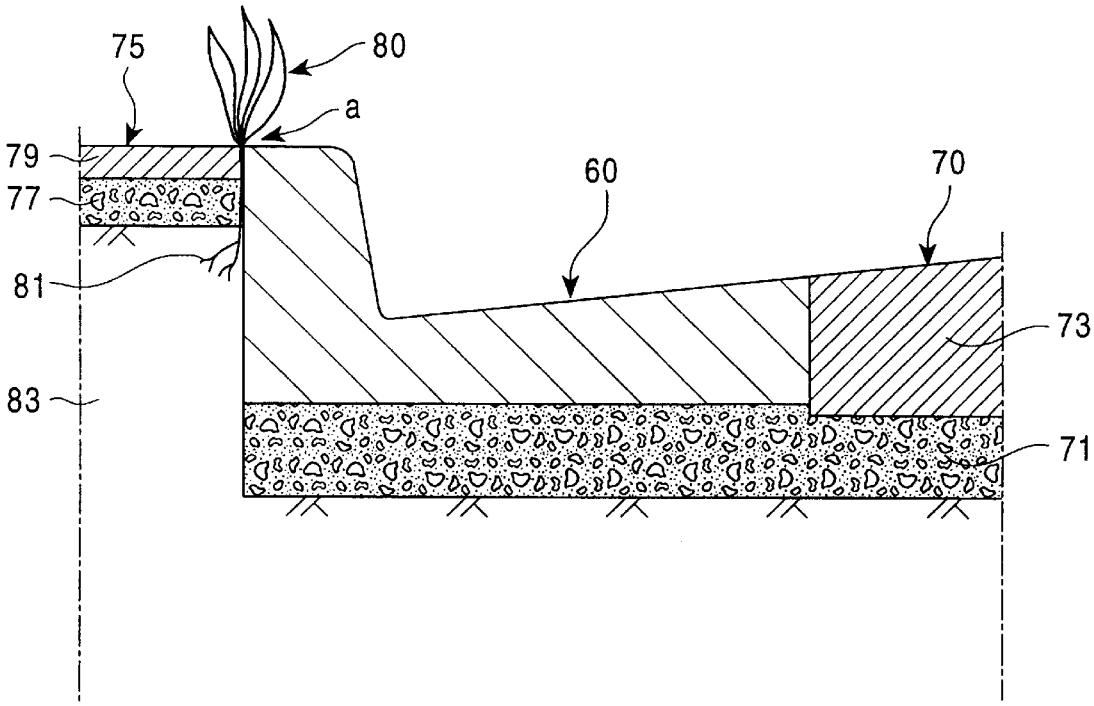
FIG. 6 PRIOR ART
FIG. 6 is a sectional view showing an example of use of a conventional apron block.
Figure 7:
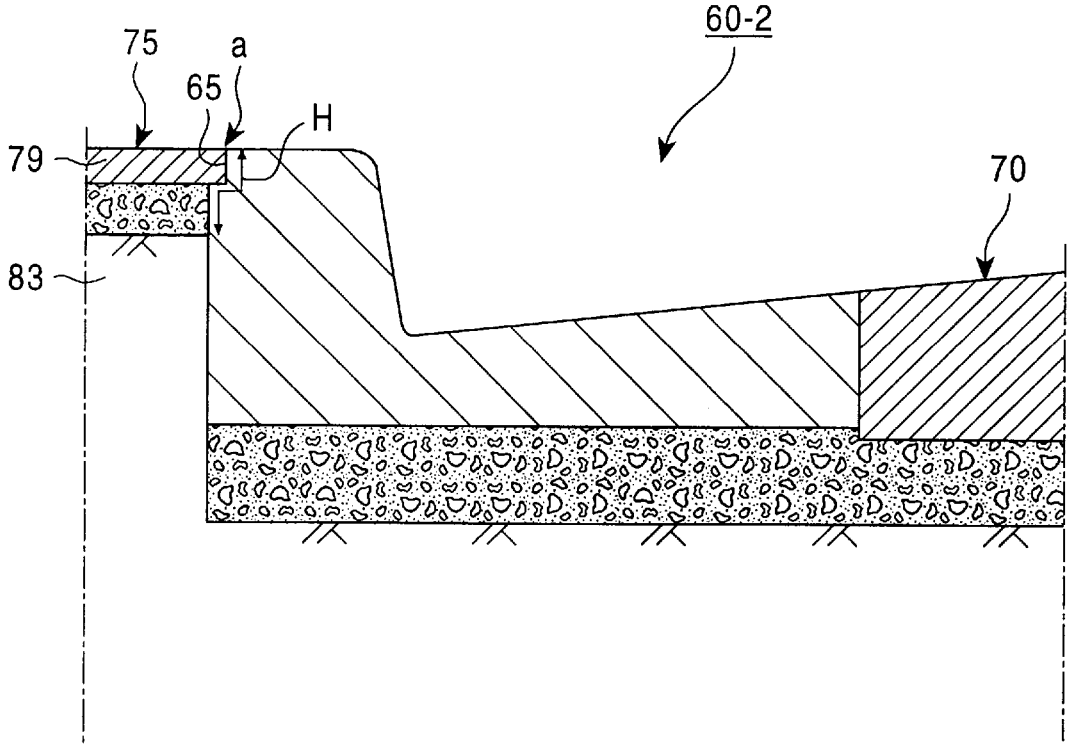
FIG. 7 PRIOR ART
FIG. 7 is a sectional view showing an example of use of another conventional apron block.
Figure 8:
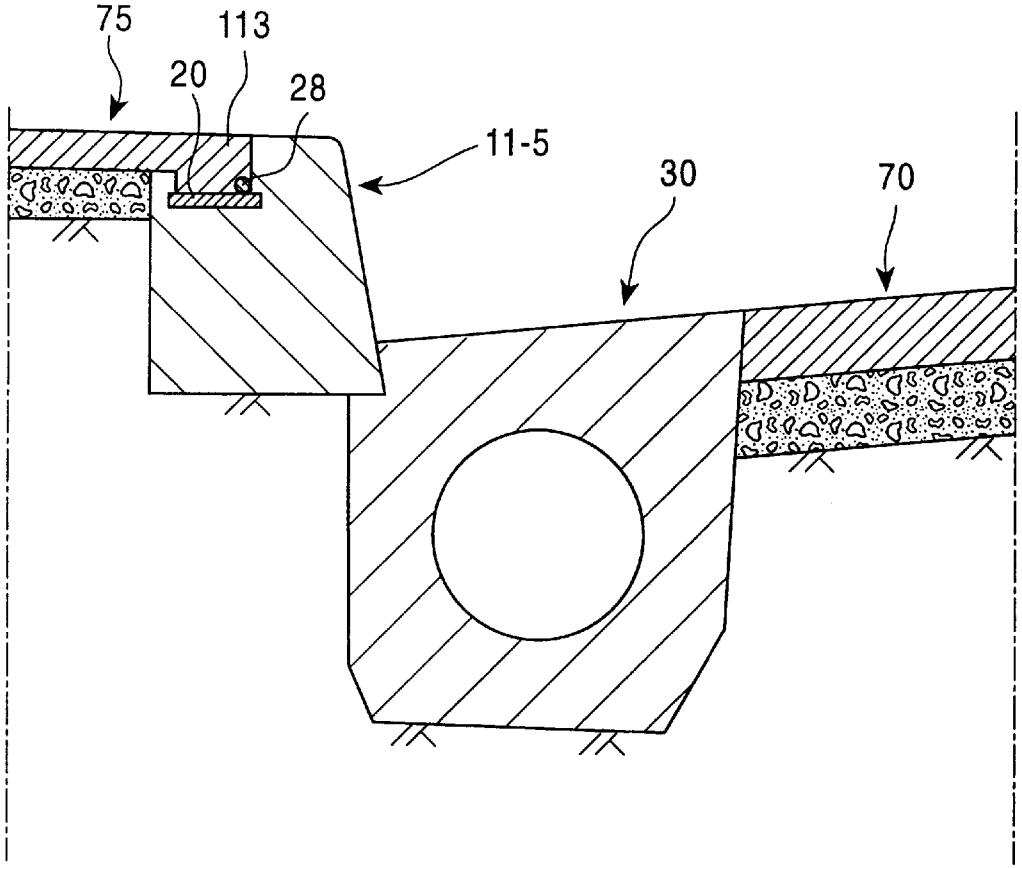
FIG. 8 is a sectional view showing a further embodiment of the present invention.

(1) The weed control apron blocks 10 and 10-2 in the embodiments shown in FIGS. 1, 2, 3 and 4 are integral blocks each comprising the curb portion 11 and the apron portion 13. However, the weed control apron block may be arranged as shown in FIG. 5. That is, the weed control apron block 10-5 shown in FIG. 5 comprises a weed control block 11-5 and an apron portion 13-5, which are produced independently of each other, and in actual use, the weed control block 11-5 and the apron portion 13-5 are combined with each other in an L-shape. The weed control block 11-5 shown in FIG. 5 may be laid alone, without the apron portion 13-5. In short, the present invention is applicable to any blocks laid on the boundary of a sidewalk regardless of the shape of the blocks. More specifically, in a case where, as shown for example in FIG. 8, a weed control block 11-5 without an apron portion is combined with a side drain 30 to form a boundary between a sidewalk and a roadway, an upper end edge of the weed control block 11-5 which is closer to the sidewalk 75 is provided with a step portion 113 extending longitudinally of the weed control block 11-5, and an iron plate 20 or a heating wire 28 is installed in the step portion 113.

Figure 11:
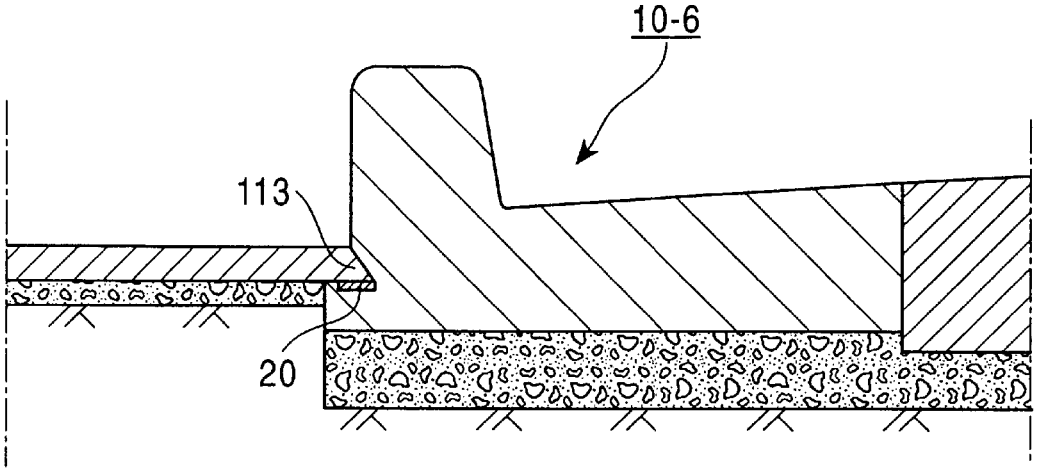
FIG. 11 is a sectional view showing a still further embodiment of the present invention.
Figure 12:
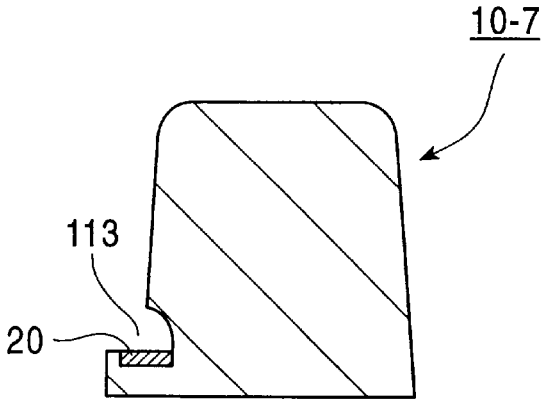
FIG. 12 is a sectional view showing a still further embodiment of the present invention.

(2) As shown in FIGS. 11 and 12, a step portion 113 may be provided on the sidewalk-side wall of an apron block 10-6 or a weed control block 11-7 without an apron portion.

(3) The configurations of the iron plate, the step portion and the recess may be modified in a variety of ways. For example, the iron plate does not always need to be a single plate. A plurality of iron plates may be used in combination. The step portion and the recess may have any configurations, provided that the step portion and the recess are covered with the sidewalk-side asphalt.

(4) Although in the foregoing embodiments an iron plate is used as a member having a high thermal conductivity, it is also possible to use other metals or other materials as long as they have a high thermal conductivity.

(5) The upper surface of the iron plate may be covered with a thin layer of cement. With this arrangement, the growth of the roots of weeds can be inhibited even more effectively because cement is alkaline.

Further, the present invention may be carried out in various other forms without departing from the spirit and essential features thereof. Therefore, the above-described embodiments are merely illustrative examples, and the present invention should not be construed as being limited to the described embodiments. The technical scope of the present invention is defined by the appended claims, and it is not bound to this specification. Furthermore, all changes and modifications within the technical scope of the claims come within the scope of the present invention.

What I claim is:

1. A weed control block laid on the boundary of a sidewalk to prevent the propagation of weeds comprising:

a block shaped to abut a sidewalk;

a step portion extending longitudinally along the block proximate the sidewalk; and at least one member having a high thermal conductivity installed in the step portion and extending longitudinally therein;

wherein the at least one member having a high thermal conductivity can increase in thermal energy from the exposure of the sidewalk to sunlight and as a result the propagation of weeds near the weed control block can be effectively prevented.

2. The weed control block of claim 1, wherein the block is made of concrete.

3. The weed control block of claim 1, wherein the at least one member having a high thermal conductivity is made of iron.

4. The weed control block of claim 1, wherein the block has a curb portion abutting the sidewalk and an apron portion proximate a road surface.

5. The week control block of claim 1, wherein the step portion is formed in a side-wall of the block.

6. The weed control block of claim 1, further comprising a heating wire installed in the step portion and extending longitudinally therein; wherein electric current can be passed through the heating wire and as a result the propagation of weeds near the weed control structure can be effectively prevented.

7. The weed control block of claim 4, wherein the curb portion and the apron portion form an approximately L-shaped cross-section.

8. The weed control block of claim 7, wherein the curb portion and the apron portion are integrally formed.

9. The weed control block of claim 4, wherein the step portion is a notch-shaped step portion having a recess and longitudinally extending along an upper end edge of the curb portion.

10. The weed control block of claim 9, wherein the at least one member having a high thermal conductivity is installed in the step portion so that at least one surface of the at least one member is exposed.

11. The weed control block of claim 9, wherein two members having a high thermal conductivity are installed in the step portion in an L-shape configuration.

12. A weed control block laid on the boundary of a sidewalk to prevent the propagation of weeds comprising:

a concrete block shaped to abut a sidewalk, the block having a curb portion abutting the sidewalk and an apron portion proximate a road surface with the curb portion and the apron portion forming an approximately L-shaped cross-section;

a step portion extending longitudinally along the block proximate the sidewalk; and at least one iron member installed in the step portion;

wherein the at least one iron member can increase in thermal energy from the exposure of the sidewalk to sunlight and as a result the propagation of weeds near the weed control block can be effectively prevented.

13. A weed control structure laid on the boundary of a sidewalk to prevent the propagation of weeds comprising:

a block shaped to abut a sidewalk; and a heating wire abutting the block and extending longitudinally along the block proximate the sidewalk;

wherein electric current can be passed through the heating wire and as a result the propagation of weeds near the weed control structure can be effectively prevented.

14. A weed control block laid on the boundary of a sidewalk to prevent the propagation of weeds comprising:

a block shaped to abut a sidewalk;

a step portion extending longitudinally along the block proximate the sidewalk; and a heating wire installed in the step portion and extending longitudinally therein;

wherein electric current can be passed through the heating wire and as a result the propagation of weeds near the weed control structure can be effectively prevented.

15. The weed control block of claim 14, wherein the block is made of concrete.

16. The weed control block of claim 14, wherein the block has a curb portion abutting the sidewalk and an apron portion proximate a road surface.

17. The weed control block of claim 16, wherein the curb portion and the apron portion form an approximately L-shaped cross-section.

18. The weed control block of claim 16, wherein the step portion is a notch-shaped step portion having a recess and longitudinally extending along an upper end edge of the curb portion.

* * * * *